US006695645B2

(12) United States Patent
Takahashi

(10) Patent No.: US 6,695,645 B2
(45) Date of Patent: Feb. 24, 2004

(54) CONNECTOR

(75) Inventor: Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/162,895

(22) Filed: Jun. 6, 2002

(65) Prior Publication Data

US 2002/0187678 A1 Dec. 12, 2002

(30) Foreign Application Priority Data

Jun. 7, 2001 (JP) ..... 2001-172192

(51) Int. Cl.[7] ..... H01R 13/436
(52) U.S. Cl. ..... 439/596; 439/752
(58) Field of Search ..... 439/596, 752

(56) References Cited

U.S. PATENT DOCUMENTS 6,165,012 A * 12/2000 Abe et al. ..... 439/596
6,176,740 B1 * 1/2001 Abe et al. ..... 439/596
6,416,700 B1 * 7/2002 Hatagishi et al. ..... 439/596

FOREIGN PATENT DOCUMENTS

JP 8-17504 1/1996

* cited by examiner

*Primary Examiner*—Gary Paumen
(74) *Attorney, Agent, or Firm*—Armstrong, Kratz, Quintos, Hanson & Brooks, LLP

(57) ABSTRACT

In a small connector, male and female terminals with high reliability of locking can be easily unlocked. A connector housing 10 has a housing body 11 and a cover body 25 mounted on the housing body 11. A hinge 13 is provided to join the bodies integrally. A locking bar 30 for locking a female terminal 35 is formed suspendingly, through an opening 23 of a terminal receiving chamber 12, on an operating flap 28 formed along the same plane of the cover wall 26 by slitting the cover wall 26. A pressing portion 30*b* is formed at the top end of the locking bar 30 for abutting on a free end 41*b* of a spring contact piece 41.

9 Claims, 4 Drawing Sheets

1
10
11
13
14
14a
15
16
16a
23
25
26
28
28a
28b
28c
31
34
34a
45
46
46a

CONNECTOR

BACKGROUND OF THE INVENTION

1. Field of the Invention

This invention relates to a connector, which receives a female terminal for connecting electrically with a mating male terminal, to be used in a rear window of a car.

2. Description of the Related Art

FIGS. 8, 9 show an example of such kind of a connector by prior art, which is disclosed in J.P.A. H8-17504 issued by the same applicant of this invention.

A connector housing 51 shown in FIGS. 8, 9 is provided with a terminal receiving chamber 53 opening at a front end 51*a* and at a rear end, and the terminal receiving chamber 53 has a flexible locking piece 54 at a bottom wall 53*a* thereof. A locking bar 55 supported by an expandable hinge 56 to be opened or closed freely is combined with an outer wall 51*c* at the front end 51*a* of the connector housing 51. A locking window 57 is opened in a top wall 53*b* of the terminal receiving chamber 53.

An top end 54*a* of the flexible piece 54 is fitted into a locking hole 58 being formed in a bottom surface 52*a* of a female terminal 52 to lock firstly the female terminal 52.

The locking bar 55 is for locking secondarily the female terminal 52 and provided at a free end thereof with a locking projection 59 suspendingly. A locking hook 60 is formed upwardly at an end portion of the locking projection 59 to lock the locking bar 55 in the connector housing 51.

The locking bar 55 is pushed upwardly by an energizing force of the hinge 56, as shown in FIG. 9, when the locking bar 55 does not lock the female terminal 52. For secondarily locking the female terminal 52, the locking projection 59 is pushed down to be inserted into the locking window 57 of the top wall 53*b*, and a front wall 59*a* of the locking projection 59 is abutted onto a locking portion 61*a* being formed at a rear end of an electrical contact portion 61 of the female terminal 52.

Thereby, a locking tip 60*a* of the locking hook 60 engages with an edge portion 57*a* of the locking window 57 and then, the locking bar 55 is locked in the connector housing 51. The female terminal 52 is locked doubly by the flexible locking piece 54 and the locking bar 55 to be prevented securely from being extracted from the terminal receiving chamber 53.

The hinge 56 has an arcuate thin plate connecting the outer wall 51*c* of the connector housing 51 and the locking bar 55 to form the locking bar 55 integrally with the connector housing 51. To push the locking projection 59 of the locking bar 55 toward the hinge 56, the arcuate hinge 56 is bent with larger curvature so that the length of the hinge 56 is shortened to bring the locking projection 59 near to a front top of the connector housing 51.

Even if the locking bar 55 has a small dimensional error of the length, to push the locking projection 59 toward the hinge 56, the locking projection 59 can be inserted successfully into the locking window 57 of the terminal receiving chamber 53.

Objects to be Solved

The connector housing by prior art, as mentioned above, has following objects to be solved.

The hinge 56 and the locking bar 55 protrude outwardly from the connector housing 51 so that it is concerned that the projecting portion may interfere with a car body or the like. When the locking bar 55 does not lock the female terminal 52, the locking bar 55 is pushed upwardly by an energizing force of the hinge 56. Therefore, the locking bar 55 may interfere with a car body or electrical devices if the connector housing is installed in a small room of a car body. Even if the locking bar 55 locks the female terminal 52, the hinge 56 still protrudes outwardly from the connector housing 51 and has the same drawback.

Number of electrical devices in a car is being increased and then a room for the devices in a car is being shrunk. Then, devices are required to be smaller so that devices having protrusion are undesirable.

Furthermore, it is concerned that the expandable thin plate hinge 56 may be broken to separate the locking bar 55 and the connector housing 51. The outer wall 51*c* of the connector housing 51 and the locking bar 55 are connected integrally by the hinge 56. If the locking bar 55 has a dimensional error of the length to disable for inserting the locking bar 55 into the right position of the terminal receiving chamber 53, adjusting the length of the locking bar 55 by pushing or pulling the hinge 56 is required. When the locking bar 55 is unlocked out of the connector housing 51, the locking bar 55 is required to rotate around the hinge 56. Therefor, the thin plate hinge 56 has stress concentration and may be broken.

Furthermore, it is afraid that the locking bar 55 being locked in the connector housing 51 is unlocked unexpectedly. The locking bar 55 is locked by engaging the locking tip 60*a* of the locking hook 60 with the edge portion 57*a* of the locking window 57. However, the arcuate hinge 56 between the connector housing 51 and the locking bar 55 energizes the locking bar 55 always outwardly so that the locking tip 60*a* may be out of the edge portion 57*a* of the locking window 57 and the locking bar 55 may be unlocked if the locking bar 55 protruding outwardly from the connector housing 51 is loaded unexpectedly.

To overcome the above drawback of prior art, one object of this invention is to provide a small connector which has no outward protrusions, high durability with a locking bar, high reliability of locking a terminal and easy operation of unlocking a male terminal and a female terminal.

SUMMARY OF THE INVENTION

How to Attain the Object

In order to attain the objects, a connector, according to this invention, which includes a connector housing having a terminal receiving chamber inside and a female terminal being received in the terminal receiving chamber for contacting electrically with a mating male terminal, the connector housing comprises a housing body and a cover body being mounted on the housing body for covering in the connector housing. The cover body has side walls on both side thereof and a cover wall across the side walls. An operating flap being formed in the cover wall is provided suspendingly with a locking bar being inserted into the terminal receiving chamber for locking the female terminal.

If the cover body with the cover wall is mounted in the housing body as mentioned above, the locking bar to be inserted from an opening portion to the terminal receiving chamber can be formed integrally with the cover wall of the cover body. If the locking bar is provided suspendingly on the operating flap, the locking bar can be inserted into the terminal receiving chamber without bending the operating flap outwardly from the cover wall. When closing the cover body, the locking bar goes into the terminal receiving chamber of the housing and an end portion of the locking bar abuts on an abutting portion being formed at a rear end of an electrical contact portion of the female terminal to lock the female terminal.

In the connector as mentioned above, the operating flap is formed by slitting the cover wall.

If the operating flap is formed by slitting the cover wall, as mentioned above, the operating flap can be flexible without deformation or strength reduction of the cover body.

In the connector as mentioned above, the female terminal has a spring contact piece in a cylindrical electrical contact portion and the locking bar is provided, at an end portion thereof, with a pressing portion to abut on the spring contact piece.

If the pressing portion is provided at the end portion of the locking bar as mentioned above, locking of the both terminals can be unlocked by pushing down the operating flap to make the pressing portion of the locking bar abut on the spring contact portion. An engaging portion is formed in the spring contact portion of the female terminal, and an engaged portion is formed in the electrical contact portion of the male terminal, and then, mating the engaging portion and the engaged portion, the both terminals are locked mutually to fit and connect. The spring contact portion must be pushed down to unlock the both terminals. Therefore, as mentioned above, the both terminals are easily unlocked only by pushing the operating flap.

In the connector as mentioned above, the operating flap is provided on the same plane of the cover wall and the locking bar is maintained in the terminal receiving chamber when the cover body is closed.

If the operating flap is provided on the same plane of the cover wall as mentioned above, the operating flap does not protrude outwardly from the cover body and is prevented from interfering with other devices in the both of the cover open and close conditions. The locking bar is maintained through the opening portion in the terminal receiving chamber so that it is prevented that the terminal is unlocked and extracted.

In the connector as mentioned above, a space is formed between the cover wall and the housing body.

In the above structure, the space between the cover wall and the housing body is formed as a room for bending so that a top end portion of the operating flap can be pushed downwardly at a fulcrum of a base end portion of the operating flap.

In the connector as mentioned above, the cover wall is provided with a plurality of ribs, at the inside thereof.

In the structure as mentioned above, the ribs are placed to abut on a wall of the housing body. When pushing the operating flap down, the ribs abut on the wall of the housing body so that the cover body is prevented from deforming and then only operating flap can be bent downwardly.

In the connector as mentioned above, a hinge is provided between the housing body and the cover body to join the both bodies integrally.

If the housing body and the cover body are joined integrally by the hinge as mentioned above, the cover body can be mounted in a right position of the housing body and then the locking bar can be also positioned accurately.

In the connector as mentioned above, the locking bar is provided at a free end of the operating flap and the pressing portion abuts on a free end of the spring contact piece.

If the locking bar is provided at the free end of the operating flap as mentioned above, the operating flap can be bent largely at a fulcrum of the base end portion, a fixed end, by a small pushing force and the pressing portion of the locking bar abuts on the free end of the spring contact piece to unlock the both terminals.

In the connector as mentioned above, the cover body is formed at one end portion in the length thereof with a conically tapered wall to form an electric wire insertion opening.

In the above structure, the conical tapered wall, narrowing gradually toward a rear end of the cover body, covers a rear end opening of the housing body as a female terminal insertion side so that it is prevented that a water-drop dropping on a rear window goes into the terminal receiving chamber from the rear end opening. An electric wire is clamped by the electric wire insertion opening for preventing looseness or noise.

The above and other objects and features of this invention will become more apparent from the following description taken in conjunction with the accompanying drawings.

DESCRIPTION OF THE PREFERRED EMBODIMENT

Figure 1:
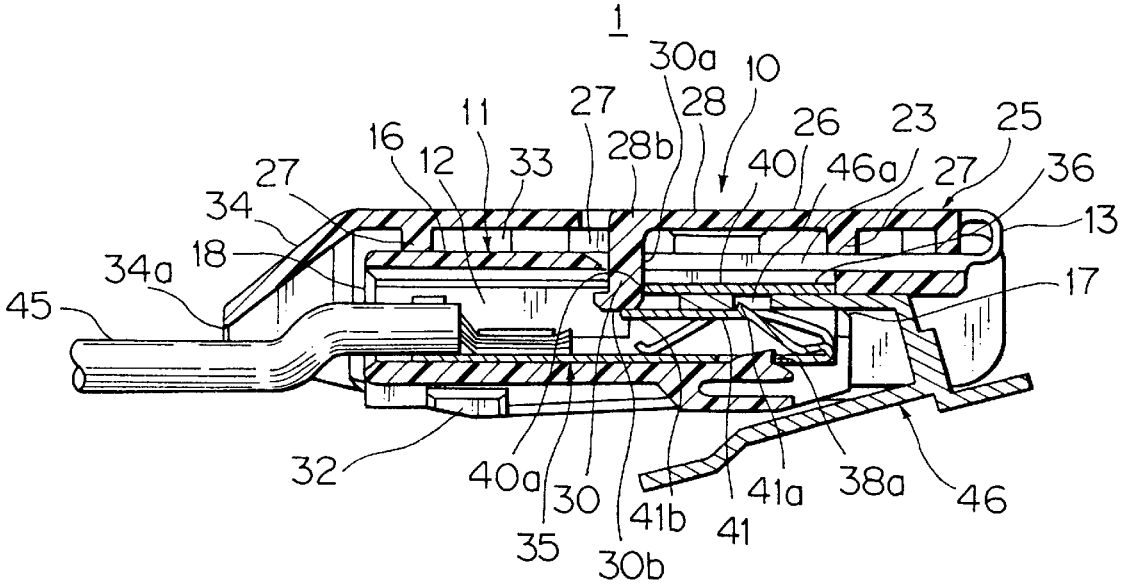
FIG. 1 is a sectional view of one embodiment of a connector according to this invention.
Figures 2, 3:
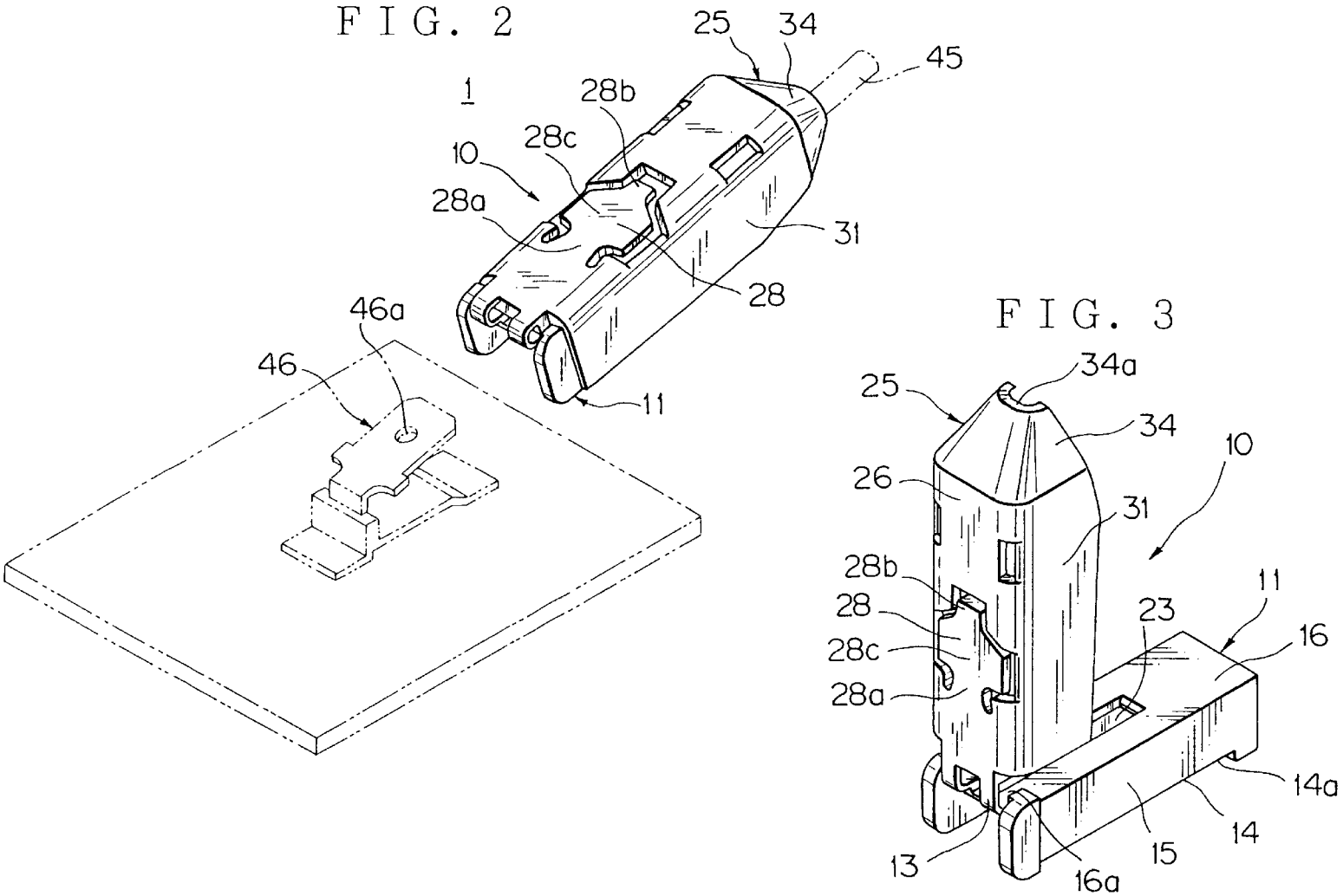
FIG. 2 is a perspective view, showing a male terminal connecting with the connector of the embodiment.
FIG. 3 is a perspective view of a housing body and a cover body of the embodiment.

An embodiment according to this invention will now be described with reference to drawings. FIGS. 1 and 2 show an embodiment of a connector, according to this invention.

A connector 1, as shown in FIG. 1, includes a connector housing 10 having a terminal receiving chamber 12 inside thereof, and a female terminal 35 being received in the terminal receiving chamber 12 and contacting electrically with a mating male terminal 46. The connector housing 10 includes a rectangular tube-shaped housing body 11 and a cover body 25 being joined to the housing body 11 with a hinge 13. This connector 1 is used for a rear defroster of a car and has a compact connector structure. The housing body 11, the cover body 25 and the female terminal 35 will be described on structures as follows.

A tabular male terminal 46 being connected with a rear defroster (not shown) is inserted from a front side of the connector 1 and goes inside with being clamped between a top plate 36 of the female terminal 35 (FIG. 1) and a spring contact piece 41. And then, a locking hole (engaged portion) 46*a* is locked by a cut-bent projection 41*a* (engaging portion) of the spring contact piece 41 in the female terminal 35 to lock the both terminals 35, 46 mutually.

For describing, directions of up-down, front-rear and right-left are defined herein. A direction in which the locking bar 30 being mounted suspendingly on a cover wall 26 of the cover body 25 can move is defined as up-down and a side of the housing body 11 which the cover body 25 is mounted on is defined as up side. A direction in which the terminals 35, 46 are inserted into the terminal receiving chamber 12 of the housing body 11 is defined as front-rear, and a side of inserting the male terminal is defined as front side and a side of inserting the female terminal 35 is defined as rear side. A direction perpendicular to up-down and front-rear directions is defined as right-left. This connector is bilaterally symmetric so that right or left side is not defined herein. The direction being defined here may not correspond to a direction of the connector 1 in use.

Figure 5:
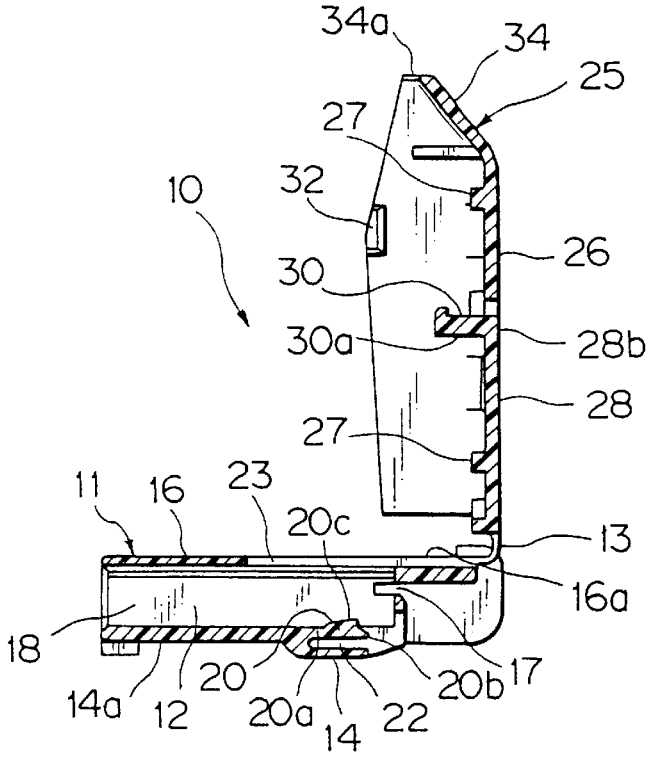
FIG. 5 is a sectional view taking along the line A—A of the housing body and the cover body shown in FIG. 4.
Figure 4:
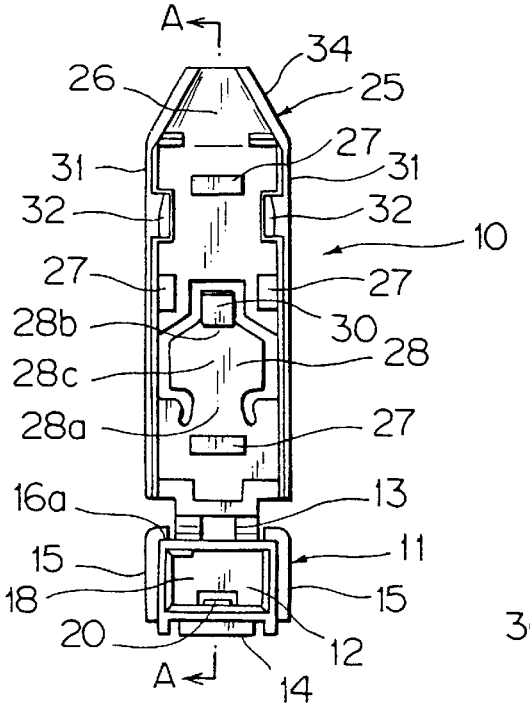
FIG. 4 is a front view of the housing body and the cover body shown in FIG. 3.

The housing body 11, as shown in FIGS. 3–5, is formed into a rectangular tube-shape by a bottom wall 14, side walls 15 standing on both sides of the bottom wall 14 and a top wall 16 across the both side walls 15. The terminal receiving chamber 12 is formed in the housing body 11 and the male terminal 46 is inserted from a front end opening 17 of one end contiguous to the terminal receiving chamber 12 and the female terminal 35 is inserted from a rear end opening 18 of the other end (FIG. 5). The rear end opening 18 opens larger than the front end opening 17. However, the rear end opening 18 is covered with a conical tapered wall 34, later described, of the cover body 25 so that infiltration of water-drops is prevented.

The bottom wall 14 is provided, in the middle area thereof, with a flexible locking piece 20 (first locking portion) for locking the female terminal 35 firstly. The flexible locking piece 20 extends in parallel to the bottom wall 14 and a base portion 20*a* of the flexible locking piece 20 is joined with the bottom wall 14 and an end portion 20*b* is a free end. A space 22 is formed between the end portion 20*b* and the bottom wall 14 to give a deformation allowance of the end portion 20*b*. The end portion 20*b* has a locking projection 20*c* fitting into a locking hole 38*a* of the female terminal 35.

Figure 6:
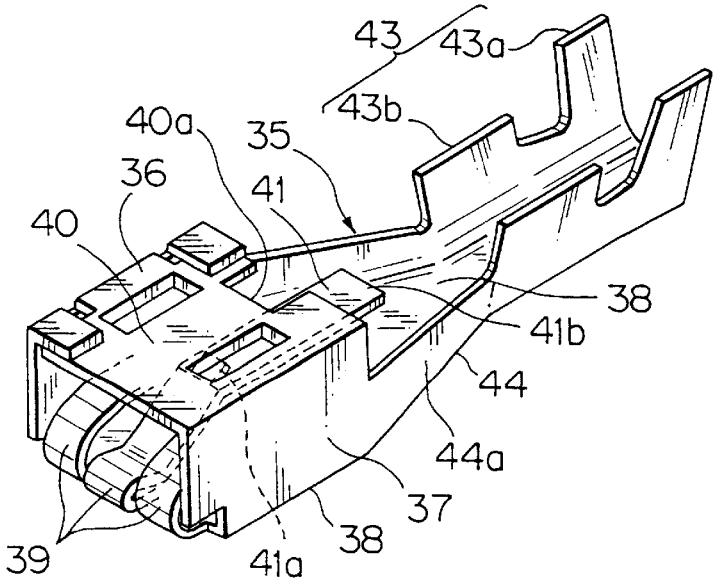
FIG. 6 is a perspective view of a female terminal of the embodiment.
Figure 8:
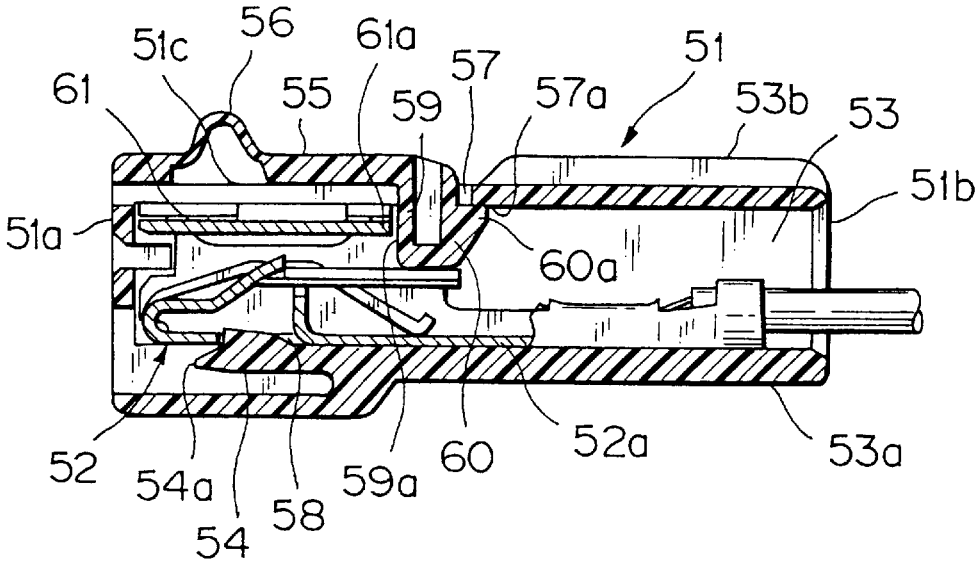
FIG. 8 PRIOR ART
FIG. 8 is a sectional view, showing a condition of locking a female terminal with a locking bar in a connector by prior art.
Figure 9:
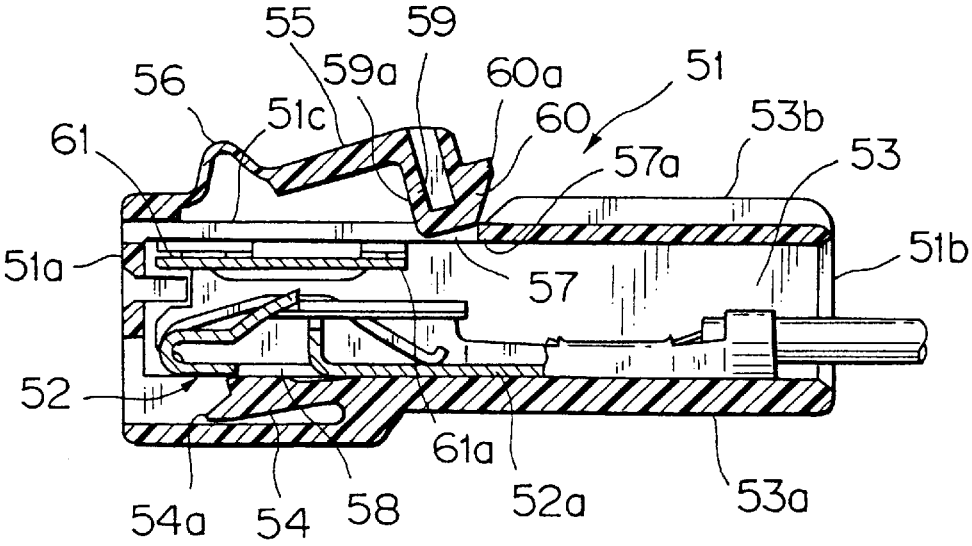
FIG. 9 PRIOR ART
FIG. 9 is a sectional view, showing a condition of unlocking the female terminal shown in FIG. 8.

The housing body 11 is formed on the top wall 16 with an opening 23 from which the locking bar 30, later described, is inserted. The opening 23 extends in a front-rear direction along the spring contact piece 41 of the female terminal 35. A most rear end of the opening 23 is located rearwardly more than the free end 41*b* of the spring contact piece 41. Therefore, the locking bar 30 can go into the terminal receiving chamber 12 without interfering with the top wall 16 to push down the free end 41*b* of the spring contact piece 41 (FIG. 6).

The housing body 11 is provided at both sides of a front end portion 16*a* of the top wall 16 with a hinge 13 for joining the cover body 25, later described, with the housing body 11. The hinge 13 is curved along a direction of opening and closing the cover body 25. The cover body 25 can be provided separately from the housing body 11. However, forming the cover body 25 integrally with the housing body 11, number of parts of the connector 1 can be reduced and the structure of the connector 1 can be simplified.

The cover body 25 being mounted on the housing body 11 is shown in FIGS. 3–5. The cover body 25 is formed to open bottom side, and has both side walls 31 and a cover wall 26 across the both side walls 31. The cover body 25 is formed integrally at a rear end thereof with the conical tapered wall 34 having the electric wire insertion opening 34*a* and contiguous to a box-shape body portion of the cover body 25.

The cover body is opened in the bottom to enable to cover an outside of the housing body 11 in a condition of closing the cover body 25. Locking a fixing hook 32 (not shown in FIG. 3) being formed projecting inwardly at a bottom area of the side wall 31 to a corner 14*a* of the bottom wall 14 of the housing body 11, the cover body 25 covers the housing body 11.

The cover wall 26 is formed into a flat plate with a plurality of ribs 27 (not shown in FIG. 3) on an inner wall surface. Thereby, a gap 33 (FIG. 1) is provided between a wall of the housing body 11 and the cover body 25 in a condition of closing the cover body 25. The gap 33 corresponds to a bending space for the operating flap 28 of the cover wall 26. Then, the operating flap 28 can be pushed down to insert the locking bar 30 being formed integrally with the operating flap 28 into the terminal receiving chamber 12. Providing the plurality of ribs 27 on the cover wall 26 prevents the cover body 25 from deforming.

The operating flap 28 is formed by slitting a middle portion of the cover wall 26, and includes a base end portion 28*a* as a foot portion, a free end portion 28*b* contiguous to the base end portion 28*a* and facing toward a rear of the cover body 25, and an operating portion 28*c* being located between the base end portion 28*a* and the free end portion 28*b*. The operating flap 28 and the cover wall 26 have almost same thickness.

The locking bar 30 is formed movably in a direction perpendicular to the free end 41*b* of the spring contact piece 41 in the female terminal 35. The housing body 11 is formed at the top wall 16 with the opening 23 so that it is not obstructed that the locking bar 30 goes in or out.

The locking bar 30 is provided at a top end thereof with a second locking portion 30*a* for an electrical contact portion 40 of the female terminal 35 and a pressing portion 30*b* for the spring contact piece 41. The second locking piece 30*a* abuts on a rear end of the electrical contact portion 40 of the female terminal 35 to prevent the female terminal 35 from being extracted rearwardly from the terminal receiving chamber 12. The female terminal 35 is doubly locked by the flexible locking piece 20 as the first locking portion and the second locking portion 30*a* (locking bar 30) to prevent securely the female terminal 35 from being extracted rearwardly.

The pressing portion 30*b* is formed to enable to abut on the free end 41*b* of the spring contact piece 41. The pressing portion 30*b* is located with a small gap against the spring contact piece 41 in a condition of closing the cover body 25. If the pressing portion 30*b* abuts always on the spring contact piece 41, the spring contact piece 41 is bent downwardly so that contact pressure for the male terminal 46 is not maintained and reliability of electrical contact between both terminals 35, 46 can not be maintained. When the male terminal 46 is extracted from the terminal receiving chamber 12, the pressing portion 30*b* is pushed down to push the spring contact piece 41 for unlocking the both terminals 35, 46.

Figure 7:
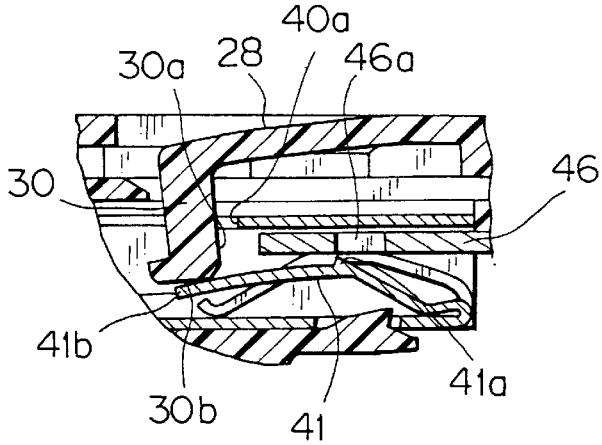
FIG. 7 is a drawing, showing an acting condition of a locking bar of the embodiment.

FIG. 7 is a drawing explaining extraction of the male terminal 46. Pushing the operating flap 28 down, the locking bar 30 is moved deeply into the terminal receiving chamber 12 and the pressing portion 30*b* pushes the spring contact piece 41 down. Then, the cut-bent projection 41*a* of the spring contact piece 41 goes out of the locking hole 46*a* of the male terminal 46 to unlock the both terminals 35, 46. Thereby, pulling the male terminal 46, the male terminal can be extracted.

In case of extracting the female terminal 35 from the terminal receiving chamber 12, the female terminal 35 is locked by the locking bar 30 so that the terminal can not be extracted in the condition. Pushing up the operating flap 28 after unlocking the both terminals 35, 46, the locking bar 30 is moved out of the terminal receiving chamber 12 to extract the female terminal 35.

FIG. 6 shows the female terminal 35 to be received in the housing body 11. The female terminal 35 is formed by punching and bending an electric conductive base plate. The female terminal 35 is provided, at a front half area thereof, with the tubular electrical contact portion 40 for receiving the male terminal 46 and electrically contacting the same, and at a rear half area, with an electric wire connecting portion 43 for connecting an electric wire 45.

The tubular electrical contact portion 40 is formed by bending the electrical conductive base plate and includes a bottom plate 38, side walls 37 at both side and a top plate 36 across the both side walls 37. The bottom plate 38 has a folded portion 39 which front end is folded toward a rear end. The folded portion 39 is divided to three with two slits and each divided portion extends rearwardly. The center divided portion is to be the spring contact piece 41 and extends in parallel to the bottom plate 38. The center divided portion is provided, at middle area, with the cut-bent projection 41*a* for locking the male terminal 46. The free end 41*b* of the center divided portion extends toward a rear side of the electrical contact portion 40 to be pushed down by the pressing portion 30*b* of the locking bar 30. The both side divided portions are curved arcuately to contact the top ends with the bottom plate 38.

The bottom plate 38 is formed in the center with a locking hole 38*a* corresponding to the flexible locking piece 20 of the housing body 11. Locking the locking projection 20*c* of the flexible locking piece 20 in the locking hole 38*a* (FIG. 1), the female terminal 35 is locked firstly.

The electric wire connecting portion 43 and the electric wire 45 (FIG. 1) are joined as crimp contact connecting by caulking. The electric wire connecting portion 43 is provided serially with a pair of covered wire clamping pieces 43*a* for clamping a covered wire and a pair of core wire clamping pieces 43*b* for clamping a core wire.

A tapered connecting portion 44 is provided between the electrical contact portion 40 and the electric wire connecting portion 43. The tapered connecting portion 44 is opened upwardly and formed into U-shape in sectional view with tapered plates 44, at both sides, contiguous to side plates 37 of the electrical contact portion 40 and the bottom plate 38 spanning the both tapered plates 44*a*. The free end 41*b* of the spring contact piece 41 extends to the tapered connecting portion 44. The tapered connecting portion 44 is opened upwardly so that the locking bar 30 can go inwardly to abut on the free end 41*b* of the spring contact portion 41.

Inserting the male terminal 46 between the top plate 36 of the female terminal 35 and the spring contact piece 41, the female terminal 35 and the male terminal 46 are locked mutually. When the male terminal 46 is inserted to a predetermined position, the cut-bent projection 41*a* of the spring contact piece 41 engages with the locking hole 46*a* of the male terminal 46 and then the both terminals 35, 46 are locked.

Although the present invention has been fully described by way of examples with reference to the accompanying drawings, it is to be noted that various change and modifications can be made with the scope of the present invention.

What is claimed is:

1. A connector, comprising:

a connector housing having a terminal receiving chamber inside; and a female terminal being received in the terminal receiving chamber for contacting electrically with a mating male terminal;

the connector housing comprising:

a housing body in the connector housing; and a cover body being mounted on the housing body for covering the connector housing, wherein the cover body has side walls on both sides thereof and a cover wall across the side walls, said cover wall having an operating flap provided suspendingly with a locking bar for inserting into the terminal receiving chamber for locking the female terminal in said chamber.

2. The connector according to claim 1, wherein the operating flap is separated from the remaining portion of the cover wall by slits.

3. The connector according to claim 1, wherein the female terminal has a spring contact piece in a tubular electrical contact portion thereof, and the locking bar is provided, at an end portion thereof, with a pressing portion to abut on the spring contact piece.

4. The connector according to claim 1, wherein the operating flap is provided on the same plane of the cover wall, wherein the locking bar is maintained in the terminal receiving chamber when the cover body is closed.

5. The connector according to claim 1, wherein a space is formed between the cover wall and the housing body.

6. The connector according to claim 5, wherein the cover wall is provided with a plurality of ribs, at the inside thereof, said ribs being oriented perpendicular to a terminal receiving direction.

7. The connector according to claim 1, wherein a hinge is provided between the housing body and the cover body to join the housing body and the cover body integrally.

8. The connector according to claim 3, wherein the locking bar is provided at a free end of the operating flap, and the pressing portion abuts on a free end of the spring contact piece.

9. The connector according to claim 1, wherein the cover body is formed at one end portion in the length thereof with a conically tapered wall to form an electric wire insertion opening.

* * * * *